US009205847B2

(12) United States Patent
Koudolo et al.

(10) Patent No.: US 9,205,847 B2
(45) Date of Patent: Dec. 8, 2015

(54) CRASH STRUCTURE FOR A RAILCAR

(71) Applicant: Bombardier Transportation GmbH, Berlin (DE)

(72) Inventors: Daniel Koudolo, Montreal (CA); Virgilio Hilario, St-Hubert (CA); Gilles Hérard, La Prairie (CA); André Gagnon, Boucherville (CA)

(73) Assignee: Bombardier Transportation GmbH, Berlin (DE)

( * ) Notice: Subject to any disclaimer, the term of this patent is extended or adjusted under 35 U.S.C. 154(b) by 295 days.

(21) Appl. No.: 13/912,291

(22) Filed: Jun. 7, 2013

(65) Prior Publication Data

US 2014/0360402 A1 Dec. 11, 2014

(51) Int. Cl.

| | |
|---|---|
| ***B61D 17/06*** | (2006.01) |
| ***B61D 15/06*** | (2006.01) |
| ***B61F 1/00*** | (2006.01) |
| ***B61F 1/10*** | (2006.01) |

(52) U.S. Cl.

CPC ..... *B61D 15/06* (2013.01); *B61D 17/06* (2013.01); *B61F 1/00* (2013.01); *B61F 1/10* (2013.01)

(58) Field of Classification Search

CPC ..... B61D 17/06; B61D 17/00; B61D 45/008; B61D 15/06; B61D 21/152; B61C 17/04; B61F 19/04; B61F 1/10; B60R 19/18; B61G 11/16

USPC ..... 105/392.5, 394, 456, 329.1

See application file for complete search history.

(56) References Cited

U.S. PATENT DOCUMENTS

| | | | | |
|---|---|---|---|---|
| 2,662,488 | A | 12/1953 | Clary | |
| 2,811,932 | A | 11/1957 | Clary | |
| 3,868,908 | A * | 3/1975 | Pelabon | 105/1.4 |
| 4,184,434 | A * | 1/1980 | Chapin | 105/456 |
| D315,536 | S | 3/1991 | Rader | |
| 5,063,859 | A | 11/1991 | Rader | |
| 5,458,066 | A | 10/1995 | Ishida et al. | |
| 5,579,699 | A | 12/1996 | Dannawi et al. | |
| 6,158,356 | A | 12/2000 | Hachet et al. | |
| 6,561,105 | B2 | 5/2003 | Godin et al. | |
| 6,712,007 | B2 | 3/2004 | Yamamoto et al. | |
| 6,799,794 | B2 * | 10/2004 | Mochidome et al. | 296/187.03 |
| 6,886,474 | B2 | 5/2005 | Yamamoto et al. | |

(Continued)

FOREIGN PATENT DOCUMENTS

KR 20110096300 A 8/2011

*Primary Examiner* — Mark Le

(74) *Attorney, Agent, or Firm* — The Webb Law Firm

(57) ABSTRACT

A railcar includes a chassis, a front end frame, a control cab for a train operator and an energy absorbing crash structure. The chassis has a cab end and a rear end. The front end frame is connected to the cab end of the chassis. The front end frame has a pair of corner posts and a collision post structure. Each one of the pair of corner posts is located at a different corner of the chassis at the cab end. The collision post structure is located between the pair of corner posts. The control cab has a control cab floor and is located proximate the cab end. A crash energy management module, located ahead of the front end frame, includes a plurality of energy absorbers and a crash shield. The plurality of energy absorbers is attached to the front end frame. There is a left energy absorber located on a left portion of the chassis and a right energy absorber located on a right portion of the chassis. The crash shield is attached substantially vertically and laterally to the plurality of energy absorbers.

32 Claims, 8 Drawing Sheets

(56) References Cited

U.S. PATENT DOCUMENTS

| | | | | |
|---|---|---|---|---|
| 7,536,958 | B2 * | 5/2009 | Bravo et al. | 105/392.5 |
| 7,900,565 | B2 | 3/2011 | Bravo et al. | |
| 2004/0159263 | A1 | 8/2004 | Yamamoto et al. | |
| 2007/0186802 | A1 | 8/2007 | Gough | |
| 2007/0261591 | A1 | 11/2007 | Bravo et al. | |

* cited by examiner

CRASH STRUCTURE FOR A RAILCAR

FIELD OF THE INVENTION

The present invention generally relates to the field of railcars. More specifically, the invention relates to a structure designed for a cab end of a railcar that is capable of absorbing the energy in case of a crash especially between a passenger car and a locomotive.

BACKGROUND OF THE INVENTION

In order to promote greater safety of conventional intercity and commuter railroads which operate on the general railroad system with other trains including freight trains, the federal government has promulgated regulations governing passenger rail safety. Nevertheless, train operators unions have pushed for higher safety passenger railcar designs since they felt that the train operators where exposed in case of a collision with a freight locomotive. Indeed, in many commuter railcar designs, the train operator cab is placed right at the front of the railcar, being protected only by vertical beams, called corner posts, and collision posts.

Alternate designs of a cab end of passenger railcars have been proposed. For example, U.S. Pat. No. 7,900,565 to Bravo discloses a passenger railcar using a crash energy management module at the cab end of the vehicle, in front of the corner posts and collision posts. This provides additional energy absorption and further protects the train operator. However, there are a few drawbacks with this design. For one, the disclosed crash energy management module uses energy absorbers that may be exposed to high lateral loads in case of a crash with some locomotives like the ones known as the F40, MP40 and F59. These locomotives all have a pointed front end that can intrude between the energy absorbers disclosed by Bravo and pushes them sideways, making them less efficient in absorbing energy.

Moreover, conventional cab end design uses two vertical collision posts, extending from a floor of the railcar to its roof, that are located between the vertical corner posts. The train operator is typically seated on one side or another, between one corner post and one collision post. Although providing adequate protection for the train operator, this design restricts his field of view.

There is therefore a need for a better design of a crash structure for the cab end of a railcar.

SUMMARY OF THE INVENTION

It is an object of the present invention to provide a crash structure for the cab end of a railcar that overcomes or mitigates one or more disadvantages of known crash structures, or at least provides a useful alternative.

The invention provides the advantages of providing a crash structure for the cab end of a railcar allowing better visibility to the train operator. Moreover, the present invention provides a crash structure adapted to cope with a crash with some types of locomotives.

In accordance with an embodiment of the present invention, there is provided a railcar having a chassis, a front end frame, a control cab for a train operator and an energy absorbing crash structure. The chassis has a cab end and a rear end. The front end frame is connected to the cab end of the chassis. The front end frame includes a pair of corner posts and a collision post structure. Each one of the pair of corner posts is located at a different corner of the chassis at the cab end. The collision post structure is located between the pair of corner posts. The control cab has a control cab floor and is located proximate the cab end. A crash energy management module, located ahead of the front end frame, has a plurality of energy absorbers and a crash shield. The plurality of energy absorbers is attached to the front end frame. There is a left energy absorber located on a left portion of the chassis and a right energy absorber located on a right portion of the chassis. The crash shield is attached substantially vertically to the plurality of energy absorbers. The crash shield and the plurality of energy absorbers are operative to transfer vertical and lateral loads to the chassis.

Optionally, the crash shield may include a grabbing aperture laterally located in a median region of the crash shield. This grabbing aperture extends vertically from at most 56.5 inches above top of rail to at least 67 inches above top of rail.

Preferably, the control cab is located behind the crash energy management module. The plurality of energy absorbers has four energy absorbers: two of the four energy absorbers are located on a right portion of the railcar while the other two energy absorbers are located on a left portion of the railcar. Two of the four energy absorbers may substantially be aligned with the chassis while the other two energy absorbers may substantially be aligned with the control cab floor which may be located higher than the chassis on which a lower passenger floor is installed. Advantageously, the four energy absorbers are also vertically centered about a level of a floor deck of a locomotive. Optionally, the four energy absorbers may be attached to the collision post structure and may form a square pattern.

Optionally, the railcar further includes an upper passenger floor and the control cab floor is located at a height intermediate that of the lower passenger floor and that of the upper passenger floor.

Optionally, the railcar may further include a protection shell that extends laterally between the pair of corner posts and vertically from the control cab floor. This protection shell is operative to prevent longitudinal intrusion within the control cab.

Preferably, the control cab is located above the crash energy management module and extends laterally between the pair of corner posts.

Optionally, the collision post structure has two lower collision posts, a structural beam, also known as a structural shelf, and an upper collision post. The two lower collision posts extend vertically from the chassis to an intermediate height of the railcar. The structural shelf, which extends transversally and continuously at least between the pair of corner posts, connects top portions of the two lower collision posts. The upper collision post extends from the structural shelf to a top portion of the railcar. The upper collision post is aligned with a median vertical plane of the railcar. Advantageously, the structural shelf may at least partially overlap each one of the pair of corner posts.

Optionally, the two lower collision posts have at least an upper portion that is canted forward, thereby providing additional space in the control cab.

Optionally, the pair of corner posts extend substantially vertically and continuously from the chassis up to an upper portion of the railcar, or up to an anti-telescoping plate.

The railcar may include an exterior sloped shell. The crash energy management module is located within the exterior sloped shell.

Preferably, the railcar is a passenger railcar.

In accordance with another embodiment of the present invention, there is provided a railcar having a chassis, a front end frame, a control cab for a train operator and a crash energy management module. The front end frame is connected to a cab end of the chassis. The front end frame includes a pair of corner posts and a collision post structure. Each one of the pair of corner posts is located at a different corner of the front end frame. The collision post structure is located between the pair of corner posts. The collision post structure has two lower collision posts, a structural shelf and an upper collision post. The lower collision posts extend substantially vertically from the chassis to an intermediate height of the railcar. The structural shelf connects top portions of the two lower collision posts and extends transversally between the pair of corner posts. The upper collision post extends from the structural shelf to a top portion of the railcar and is aligned with a longitudinal median vertical plane of the railcar. The control cab is located proximate the front end. The crash energy management module is located ahead of the front end frame.

Optionally, the control cab and its floor extend laterally between the pair of corner posts, or in other words from one corner post to the other corner post.

The two lower collision posts may have at least an upper portion that is canted forward, thereby providing additional space in the control cab. The structural shelf may at least longitudinally partially overlap each one of the pair of corner posts.

Optionally, the railcar further includes a protection shell extending laterally between the pair of corner posts and vertically from the control cab floor. The protection shell is operative to prevent longitudinal intrusion within the control cab.

Preferably, the control cab is located behind and above the crash energy management module and above the lower passenger floor.

Optionally, the crash energy management module has a plurality of energy absorbers and a crash shield. The plurality of energy absorbers are attached to the collision post structure. The plurality of energy absorbers has a left energy absorber located on a left portion of the railcar and a right energy absorber located on a right portion of the railcar. The crash shield is attached substantially vertically to the plurality of energy absorbers.

The crash shield may further include a grabbing aperture that is laterally located in a median region of the crash shield. Typically, the grabbing aperture extends vertically from at most 56.5 inches above top of rail to at least 67 inches above top of rail.

The railcar may further have an upper passenger floor. The control cab floor may be located at a height intermediate that of the lower passenger floor and that of the upper passenger floor. Alternately, the control cab floor may also be located at the same level as the upper passenger floor.

Optionally, the plurality of energy absorbers includes four energy absorbers. Two of the four energy absorbers are located on a right portion of the railcar and the other two of energy absorbers are located on a left portion of the railcar. Two of the four energy absorbers are substantially aligned with the chassis while the two other energy absorbers are substantially aligned with the control cab floor.

Optionally, the pair of corner posts extend substantially vertically and continuously from the chassis up to an upper portion of the railcar, or up to an anti-telescoping plate.

The railcar may also include an exterior sloped shell. The crash energy management module is located within the exterior slated shell.

Preferably, the railcar is a passenger railcar.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a front end structure of a railcar, and especially to a crash structure adapted to cope with a crash with some type of a locomotive. The crash structure also provides an improved visibility for the train operator seated in the cab.

Figure 1:
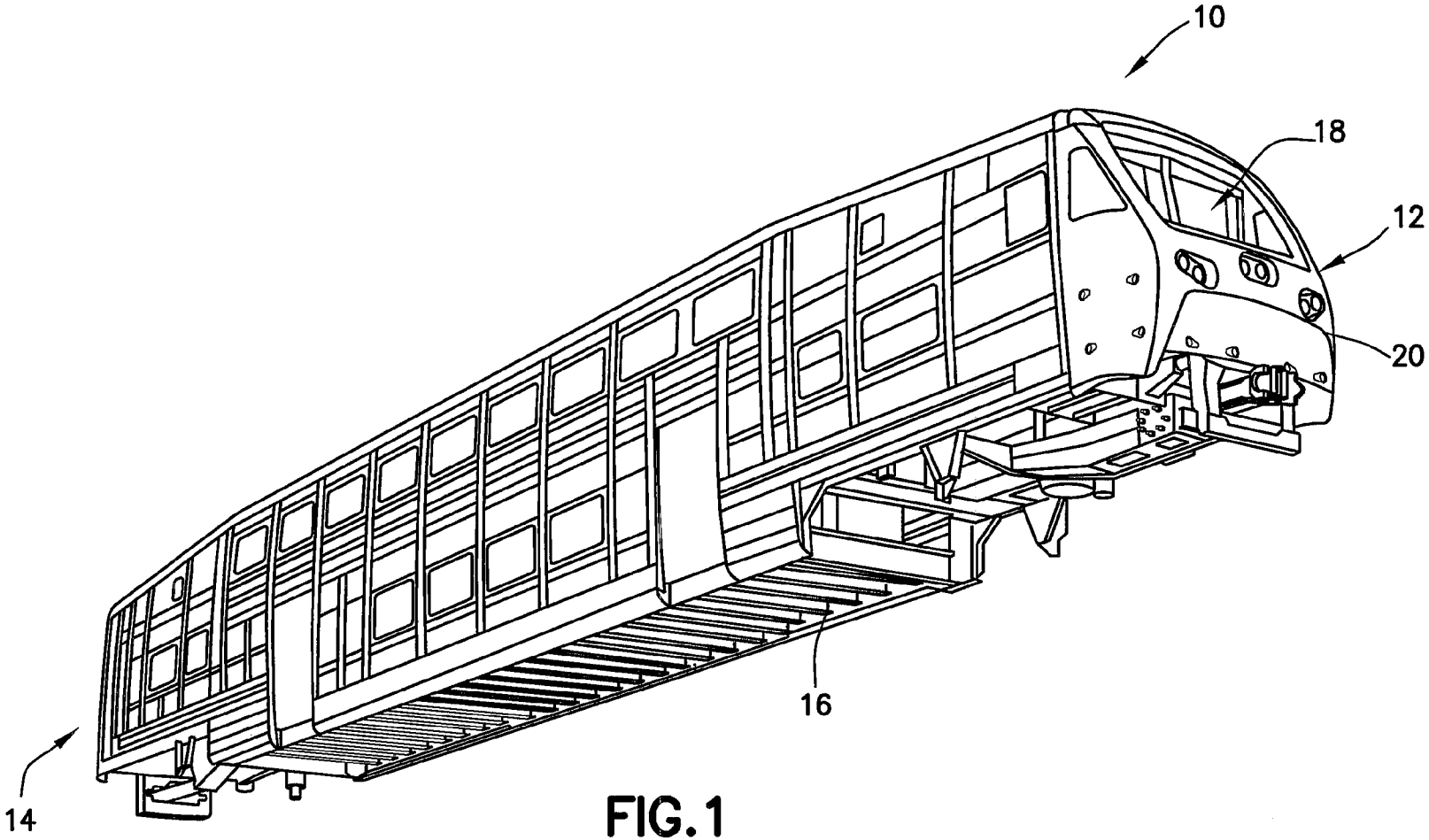
FIG. 1 is an bottom isometric view of a railcar in accordance with an embodiment of the present invention.

FIG. 1, now referred to, depicts a railcar 10. Railcar 10 is a passenger rail cab car, although the same invention described hereinafter could also be applied to a power car. The railcar 10 has a cab end 12 at the front, and a rear end 14. The railcar 10 includes a chassis 16 that extends the full length of the railcar 10, a control cab 18 for a train operator located at the cab end 12, and an exterior sloped shell 20.

Figure 2:
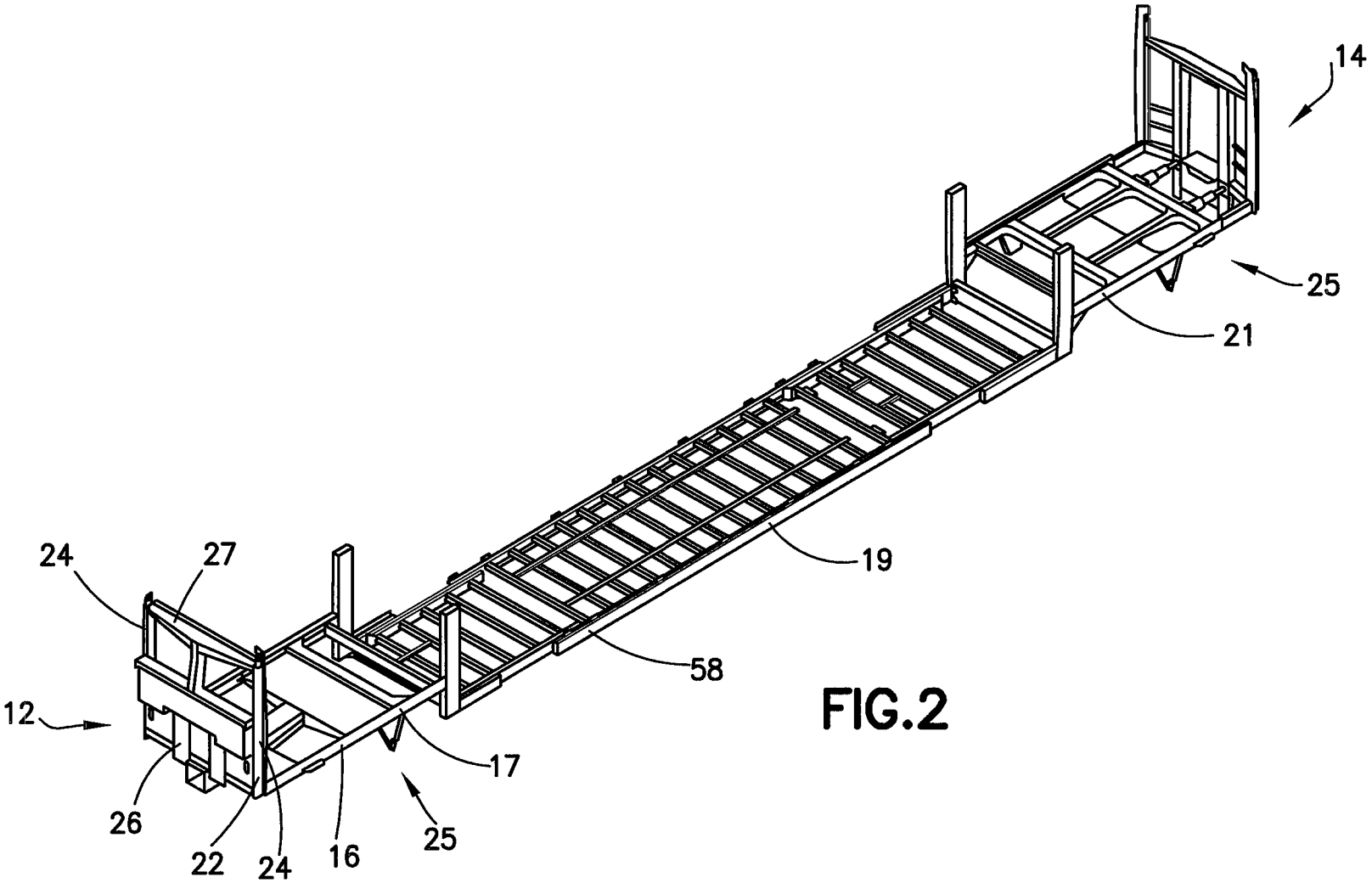
FIG. 2 is a top isometric view of a chassis of the railcar of FIG. 1.

FIG. 2 is now concurrently referred to. As can be seen, a front end frame 22 is connected to the cab end 12 of the chassis 16. In the non-limiting example of the present invention, the chassis 16 is designed for a double-deck vehicle. As such, the chassis 16 has a chassis front portion 17, a chassis intermediate portion 19 and a chassis rear portion 21. Whereas on a single-deck railcar the chassis front portion 17, the chassis intermediate portion 19 and the chassis rear portion 21 are all aligned, in a double-deck car, the chassis intermediate level 19 is placed lower than both the chassis front portion 17 and the chassis rear portion 21 in order to accommodate a second deck in the intermediate portion. A lower passenger floor 23, best shown in FIG. 3 now concurrently referred to, is installed over the chassis 16 in the chassis intermediate portion 19 and on both the chassis front portion 17 and the chassis rear portion 21. When the lower passenger floor 23 is that of a two or multi-floors vehicle, the lower passenger floor 23 may have a step over the bogie portion 25.

The front end frame 22 has a pair of corner posts 24, a collision post structure 26 and an upper horizontal beam known as an anti-telescoping plate 27 located at an upper portion of the railcar 10. Each corner post 24 is positioned at a different corner of the chassis 16 at the cab end 12. The corner posts 24 extend substantially vertically and continuously from the lower passenger floor 23, or chassis front portion 17, up to the anti-telescoping plate 27. The corner posts 24 are typically made of steel beams. The collision post structure 26 is located between the pair of corner posts 24.

Figure 4:
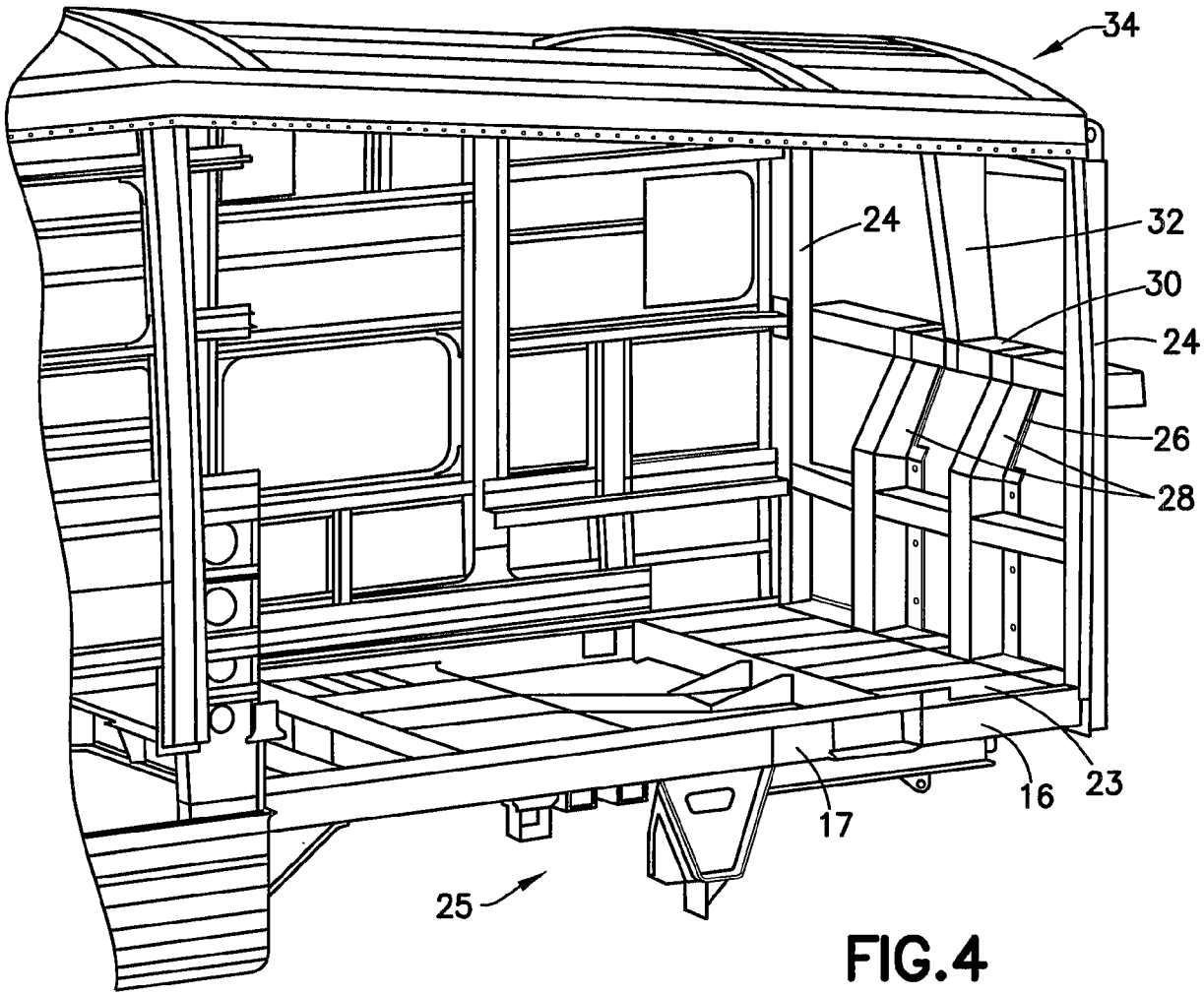
FIG. 4 is an isometric interior view of a front end frame of the railcar of FIG. 1.
Figure 5:
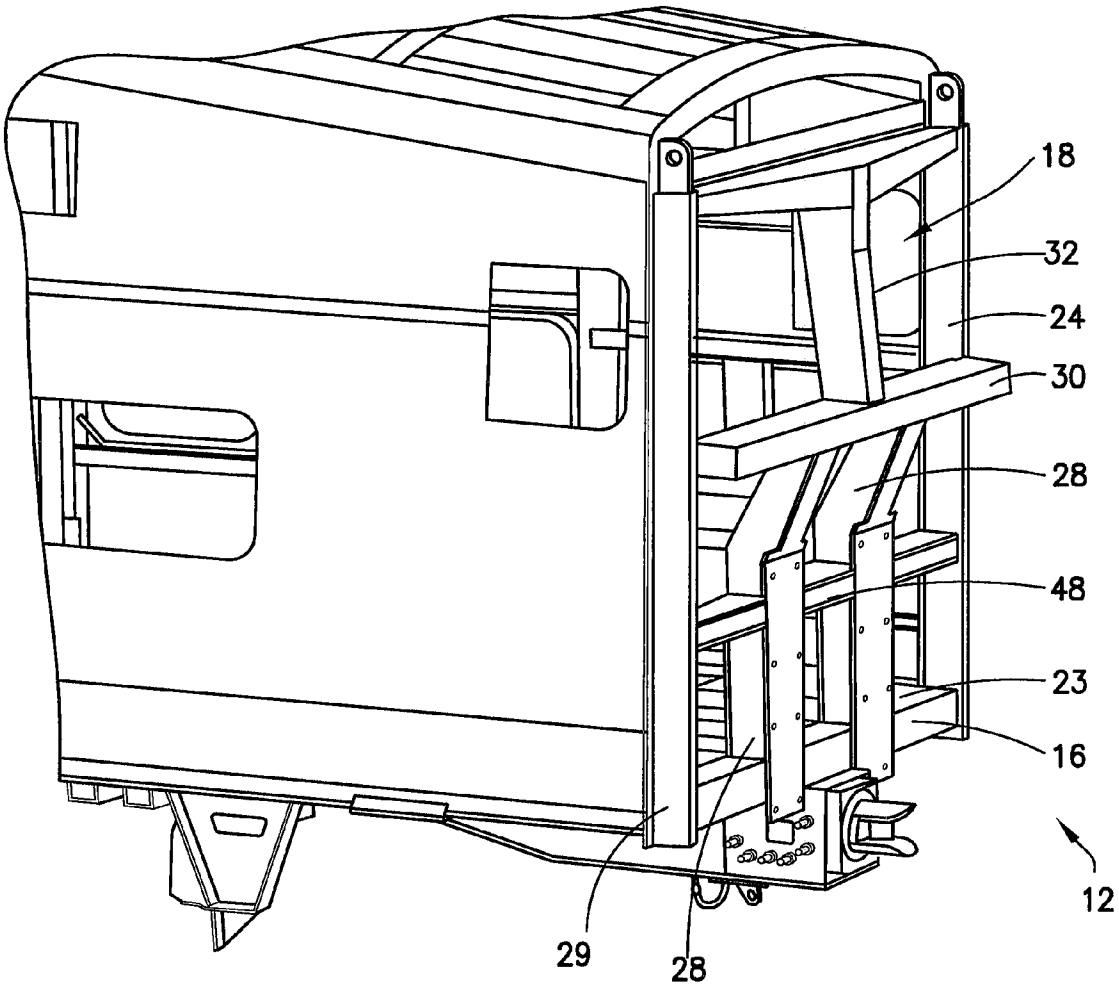
FIG. 5 is an isometric front view of the front end frame of the railcar of FIG. 1.

FIG. 4 is now concurrently referred to. The collision post structure 26 is made of two lower collision posts 28, a structural shelf 30 and a single upper collision post 32. The two lower collision posts 28 extend from a lower portion of the chassis 16 to an intermediate height of the railcar where a structural shelf 30 is transversally installed between the pair of corner posts 24. The structural shelf 30, which extends continuously at least between the corner posts 24, also connects top portions of the two lower collision posts 28 and the corner posts 24 together. Advantageously, the structural shelf 30 may overlap the corner posts 24 so that all are continuous and thereby provide an improved structural integrity. This overlap is also possible because of the peculiar shape of the lower collision post 28, as will be discussed below. The upper collision post 32 extends from the structural shelf 30 to the anti-telescoping plate 27 at a railcar top portion 34. The upper collision post 32 is aligned with a longitudinal vertical center plane of the railcar 10. Since the structural shelf 30 extends symmetrically from one corner of the railcar 10 to another corner, the upper collision post 32 is connected to a middle portion of the structural shelf 30 and thereby divides a windshield of the control cab 18 in two halves. This is a substantial advantage as the single upper collision post allows for an improved visibility for a train operator 38 (best shown in FIG. 7) over many previous collision post structures which have two collision posts up to the railcar top portion. As can be best seen in FIG. 5, the two lower collision posts 28 may have their upper portion bent forward. This advantageously pushes the structural shelf 30 forward, thereby providing additional space in the control cab 18 for the legs and knees of the train operator 38 and allowing the overlap between the structural shelf 30 and the two corner posts 24.

Figure 6:
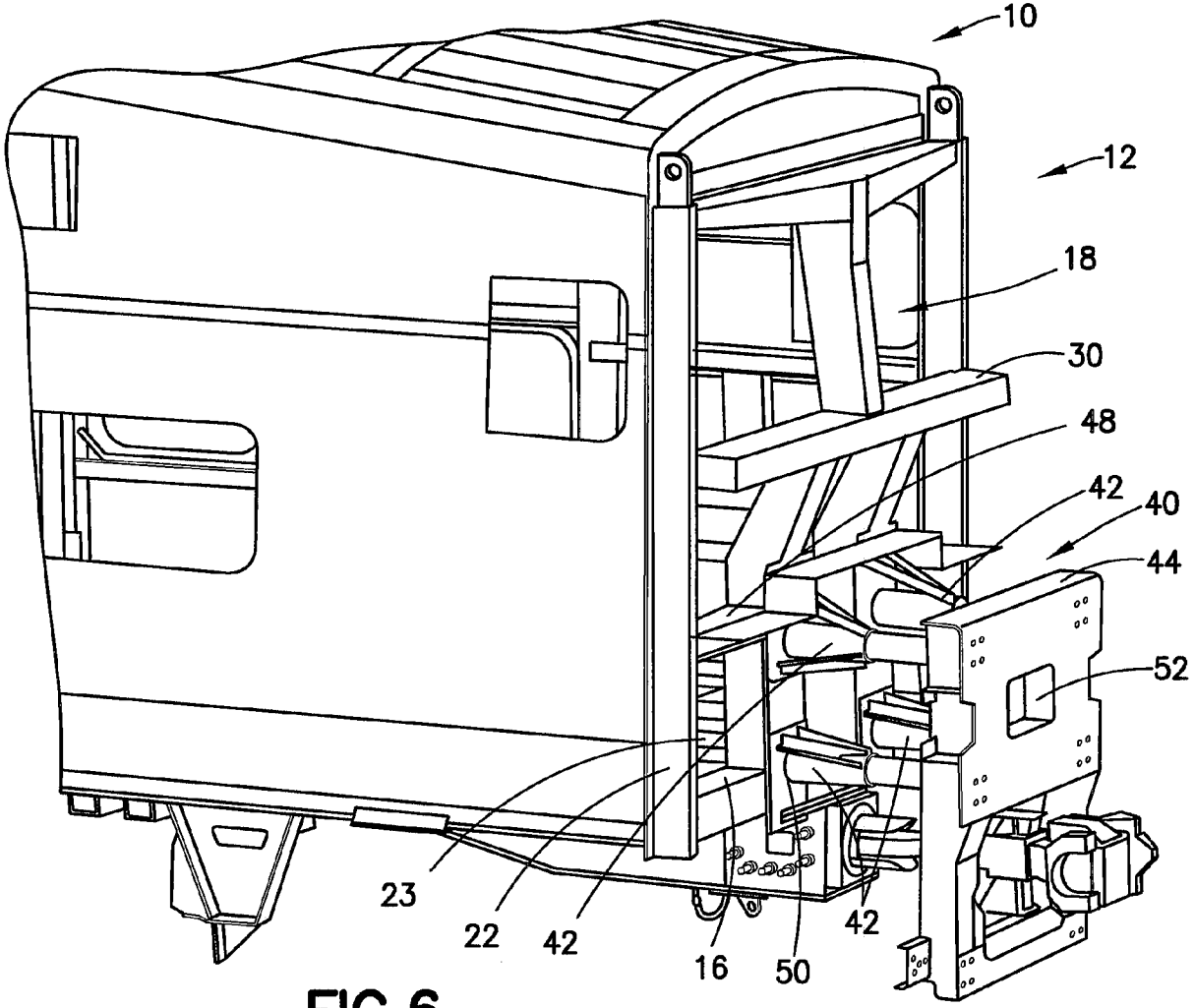
FIG. 6 is an isometric view of a cab end of the railcar of FIG. 1 showing a crash energy management module.

FIG. 6 is now concurrently referred to. In order to absorb energy in case of a crash and provide protection for the train operator 38, chassis 16 and front end frame 22, a crash energy management module 40 is added to the railcar 10, ahead of the front end frame 22. The crash energy management module 40 includes a plurality of energy absorbers 42 and a crash shield 44. The energy absorbers 42 are attached to the front end frame 22. Advantageously, the energy absorbers may be removably attached, with the help of screws or bolts for example, so that they can be easily replaced if damaged during a crash. Although any number of energy absorbers 42 may be used, the present design shows four energy absorbers 42 located symmetrically with respect to the longitudinal vertical center plane of the railcar 10: two of the four energy absorbers 42 are located on a right portion of the railcar while the other two energy absorbers 42 are located on a left portion of the railcar. Two energy absorbers 42 may substantially be aligned with the chassis 16 while the other two energy absorbers may substantially be aligned with a control cab floor 48, located higher than the chassis 16. As can be seen, the four energy absorbers 42 are attached to the collision post structure 26 and form a square pattern. Advantageously, the energy absorbers 42 may be vertically centered about a level of a floor deck of a locomotive, thereby distributing as evenly as possible the impact energy within the energy absorbers 42.

The crash shield 44 is attached substantially vertically and laterally to the four energy absorbers 42. The crash shield 44 has three functions: 1) it distributes an eventual crash load over the energy absorbers 42, thereby making them work as one unit; 2) it links together the four energy absorbers 42, and especially the right ones to the left ones, so that they remain laterally and vertically stable and collapse mostly longitudinally in case of a crash. This is important because some locomotives have a pointed front end that, absent the crash shield 44, would penetrate between the energy absorbers 42 and push them outwardly, the energy absorbers then rotating on their attachment base 50 at the collision post structure 26; and 3) using its central grabbing aperture 52, the crash shield 44 is capable of grabbing the pointed front end of a locomotive crashing into it and prevent the locomotive from climbing over the railcar 10, therefore acting as an anti-climbing device.

As described, the crash shield 44 is designed to work with certain types of locomotives, including, but not limited to, F40, MP40 and F59 locomotives, which all have in common that their floor has a pointed end at their front end. The crash shield 44 is also designed to distribute vertical and lateral loads to the energy absorbers 42 and to transfer this load through the energy absorbers 42 to the front end frame 22. To be effective, the grabbing aperture 52 is centered on the longitudinal vertical center plane of the railcar 10 and centered at a vertical position corresponding approximately to that of a locomotive floor deck. The grabbing aperture 52, substantially rectangular in shape, may extend vertically from 50 inches above top of rail (TOR) to 75 inches above TOR. Preferably, the grabbing aperture 52 extends from 56.5 inches above TOR to 67 inches above TOR.

Figure 7:
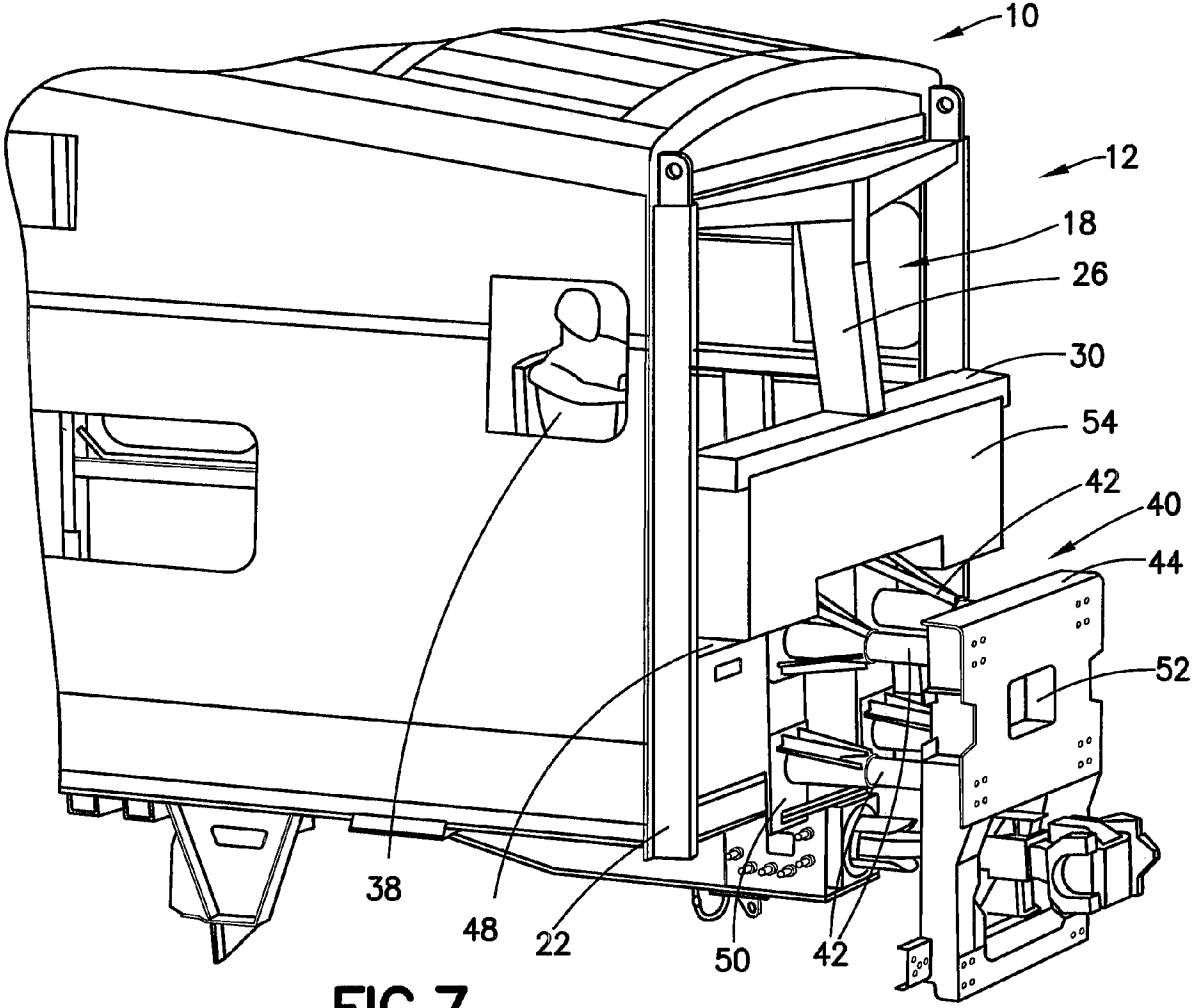
FIG. 7 is an isometric view of the cab end of the railcar of FIG. 1 showing a crash energy management module and a protection shell.

FIG. 7 is now concurrently referred to. The cab end 12 may further be provided with a protection shell 54, also known as a ballistic plate, extending laterally between the pair of corner posts 24 and vertically from the control cab floor 48 to the structural shelf 30. This protection shell 54 is operative to provide protection against intrusion of impacting objects into the control cab 18, and in particular smaller objects that could pass through either between one of the corner posts 24 and one of the lower collision posts 28 or between both lower collision posts 28.

In order to better protect the train operator 38, the control cab 18 is located behind the crash energy management module 40 and behind the front end frame 22. The control cab 18 has a control cab floor 48 that may extend the whole width of the railcar 10 (best shown in FIG. 6), or in other words from one corner post 24 to the other corner post 24. Such a whole-width floor provides an airy control cab 18 for the train operator 38.

Figure 3:
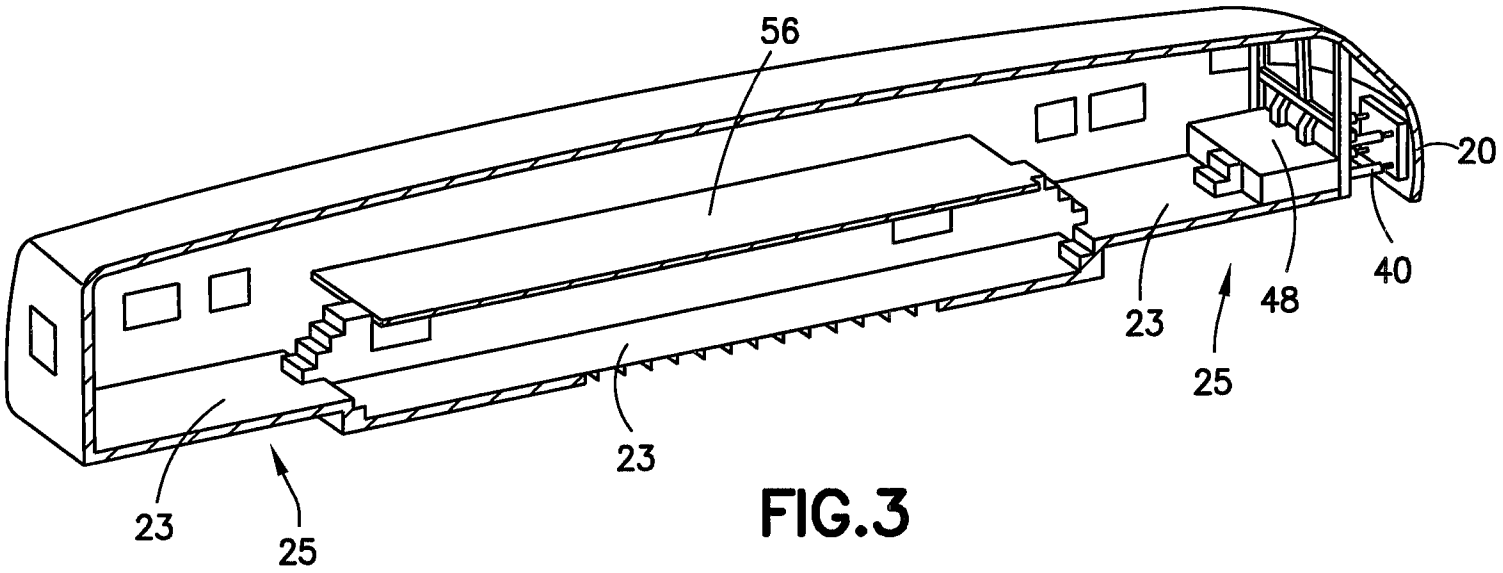
FIG. 3 is a cut-away isometric view of the railcar of FIG. 1 showing a lower passenger floor, an upper passenger floor and a cab floor.

As seen in FIG. 3, the control cab floor 48 is located above the lower passenger floor 23 and preferably above the crash energy management module 40. In the non-limiting example provided, the railcar 10 is provided with an upper passenger floor 56. The control cab floor 48 is located at a height intermediate that of the lower passenger floor 23 and that of the upper passenger floor 56. Alternatively, the cab floor 48 could be aligned with the upper passenger floor 56.

Figure 8:
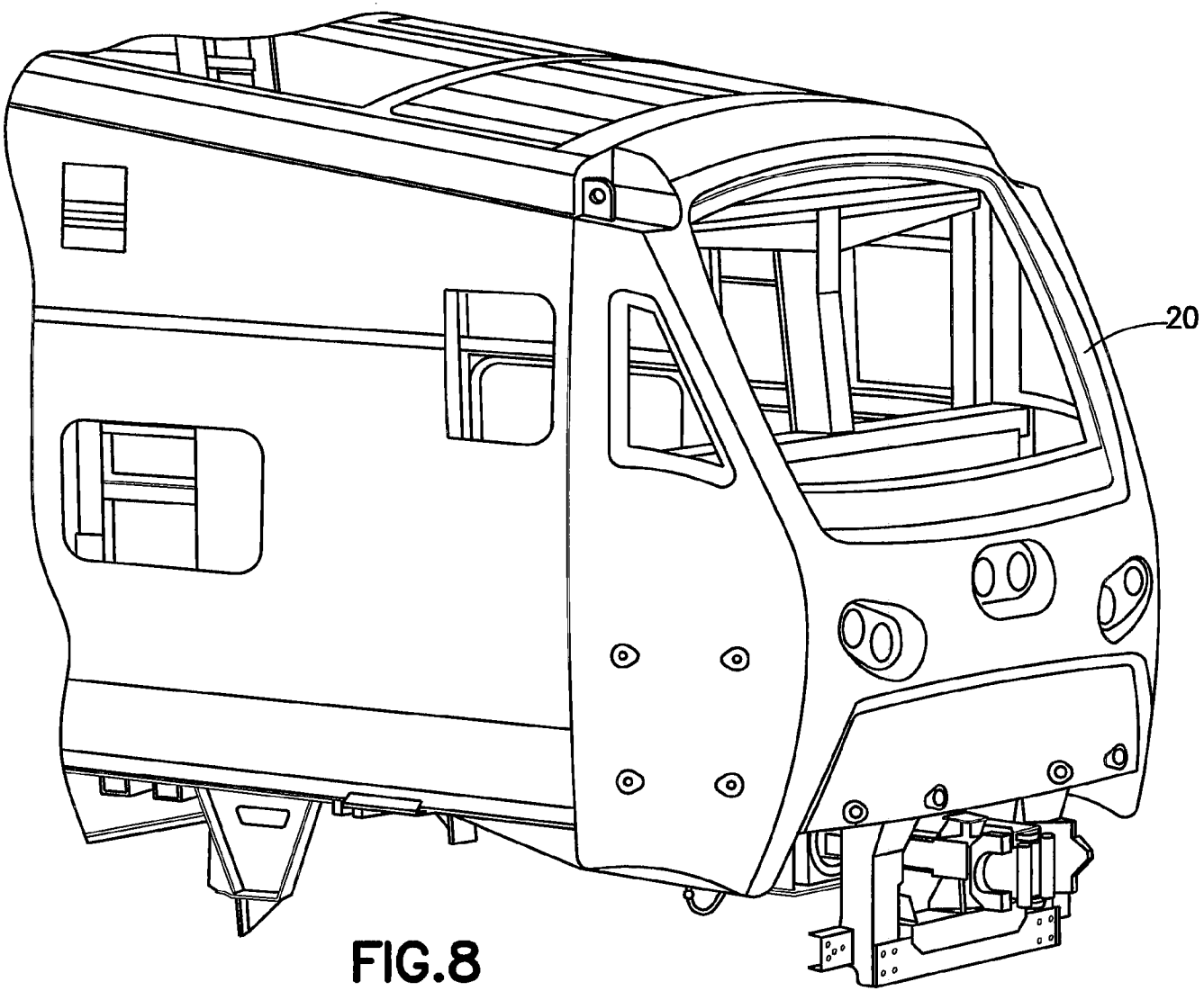
FIG. 8 is an isometric view of the cab end of the railcar of FIG. 1 showing an exterior slanted aerodynamic shell.

FIG. 8 is now referred to. To provide a nice appearance and good aerodynamic properties, the crash energy management module 40 is covered by the cosmetic exterior sloped shell 20.

Advantageously, the crash energy management module 40 is modular in nature and may be replaced by a rigid module in situations where no crash energy management features are required.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

The invention claimed is:

1. A railcar comprising:

a chassis, said chassis having a cab end and a rear end;

a front end frame, said front end frame being connected to said cab end of said chassis, said front end frame having:

a pair of corner posts, each one of said pair of corner posts being located at a different corner of said cab end of said chassis;

a collision post structure, said collision post structure being located between said pair of corner posts;

a control cab for a train operator, said control cab having a control cab floor, said control cab being located proximate said cab end;

a crash energy management module, said crash energy management module being located ahead of said front end frame, said crash energy management module having:

a plurality of energy absorbers, said plurality of energy absorbers being attached to said front end frame, said plurality of energy absorbers having a left energy absorber located on a left portion of the chassis and a right energy absorber located on a right portion of the chassis;

a plate-shaped crash shield, said crash shield being attached substantially vertically to and laterally to said plurality of energy absorbers to link the plurality of energy absorbers together; and a grabbing aperture extending through the shield and capable of grabbing a front end locomotive crashing into the railcar.

2. The railcar of claim 1, wherein said grabbing aperture is laterally and vertically located in a median region of said crash shield.

3. The railcar of claim 2, wherein said grabbing aperture extends vertically from at most 56.5 inches above a top of a rail to at least 67 inches above the top of the rail.

4. The railcar of claim 3, wherein said crash shield and said plurality of energy absorbers are operative to transfer a vertical load to said chassis.

5. The railcar of claim 2, wherein said control cab is located behind said crash energy management module.

6. The railcar of claim 5, wherein said plurality of energy absorbers comprises four energy absorbers, two of said four energy absorbers being located on a right portion of said railcar and two of said four energy absorbers being located on a left portion of said railcar.

7. The railcar of claim 6, wherein two of said four energy absorbers are substantially aligned with said chassis.

8. The railcar of claim 7, wherein said control cab floor is located higher than a lower passenger floor installed on said chassis and wherein two of said four energy absorbers are substantially aligned with said control cab floor.

9. The railcar of claim 8, wherein said energy absorbers are attached to said collision post structure.

10. The railcar of claim 9, further comprising an upper passenger floor, said control cab floor being located at a height intermediate that of said lower passenger floor and that of said upper passenger floor.

11. The railcar of claim 10, wherein said four energy absorbers form a square pattern.

12. The railcar of claim 2, further comprising a protection shell extending laterally between said pair of corner posts and vertically from said control cab floor to a structural shelf, said protection shell being operative to prevent longitudinal intrusion within said control cab.

13. The railcar of claim 1, wherein said control cab is located above said crash energy management module and extends laterally between said pair of corner posts.

14. The railcar of claim 1, wherein said collision post structure comprises:

two lower collision posts, said collision posts extending vertically from said chassis to an intermediate height of said railcar, each one of said two collision posts having a top portion; and a structural shelf, said structural shelf connecting said top portions of said two lower collision posts, said structural shelf extending transversally at least between said pair of corner posts; and an upper collision post extending from said structural shelf to a top portion of said railcar, said upper collision post being aligned with a median vertical plane of said railcar.

15. The railcar of claim 14, wherein said two lower collision posts have at least an upper portion that is canted forward, thereby providing additional space in said control cab.

16. The railcar of claim 14, wherein said structural shelf at least partially overlaps each one of said pair of corner posts.

17. The railcar of claim 1 further comprising an exterior sloped shell, said crash energy management module being located within said exterior sloped shell and wherein said railcar is a passenger railcar.

18. The railcar of claim 1, wherein said pair of corner posts extend substantially vertically and continuously from said chassis up to an upper portion of said railcar.

19. A railcar comprising:

a chassis, said chassis having a cab end;

a front end frame, said front end frame being connected to a front portion of said chassis, said front end frame having:

a pair of corner posts, each one of said pair of corner posts being located at a different corner of said front end frame;

an anti-telescoping plate, said anti-telescoping plate extending transversely at a railcar top portion;

a collision post structure, said collision post structure being located between said pair of corner posts, said collision post structure having:

two lower collision posts, said two lower collision posts extending substantially vertically from said chassis to an intermediate height of said railcar, each one of said two lower collision posts having a top portion;

a structural shelf, said structural shelf connecting said top portions of said two lower collision posts, said structural shelf extending transversally between said pair of corner posts; and an upper collision post extending from said structural shelf to said anti-telescoping plate, said upper collision post being aligned with a longitudinal median vertical plane of said railcar;

a control cab for a train operator, said control cab having a control cab floor, said control cab being located proximate said front end, said structural shelf being vertically located intermediate to said cab floor and said anti-telescoping plate; and a crash energy management module, said crash energy management module being located a head of said front end frame, said crash energy management module comprising a crash shield, said crash shield being substantially vertical, aid crash shield having a grabbing aperture capable of grabbing a front end of a locomotive crashing into the railcar, wherein said structural shelf, said upper collision post, said anti-telescoping plate, and said corner post define an opening through which the train operator may see outside said control cab.

20. The railcar of claim 19, wherein said control cab floor extends laterally from one of said pair of corner posts to another of said pair of corner posts.

21. The railcar of claim 19, wherein said two lower collision posts have at least an upper portion that is canted forward, thereby providing additional space in said control cab.

22. The railcar of claim 19, wherein said structural shelf at least partially overlaps each one of said pair of corner posts.

23. The railcar of claim 22, further comprising a protection shell extending laterally between said pair of corner posts and vertically from said control cab floor, said protection shell being operative to prevent longitudinal intrusion within said control cab.

24. The railcar of claim 21, wherein said control cab is located behind said crash energy management module, above said chassis, and above said crash energy management module.

25. The railcar of claim 24, wherein said crash energy management module comprises:

a plurality of energy absorbers, said plurality of energy absorbers being attached to said collision post structure, said plurality of energy absorbers having a left energy absorber located on a left portion of the railcar and a right energy absorber located on a right portion of the railcar, said crash shield being attached to said plurality of energy absorbers.

26. The railcar of claim 25, wherein said grabbing aperture is laterally located in a median region of said crash shield.

27. The railcar of claim 26, wherein said grabbing aperture extends vertically from at most 56.5 inches above a top of a rail to at least 67 inches above the top of the rail.

28. The railcar of claim 25, further comprising an upper passenger floor, said control cab floor being located at a height intermediate that of a lower passenger floor installed on said chassis and that of said upper passenger floor.

29. The railcar of claim 26, wherein said plurality of energy absorbers comprises four energy absorbers, two of said four energy absorbers being located on a right portion of said railcar and two of said four energy absorbers being located on a left portion of said railcar, wherein two of said four energy absorbers are substantially aligned with said chassis and wherein two of said four energy absorbers are substantially aligned with said control cab floor.

30. The railcar of claim 20, further comprising an exterior sloped shell, said crash energy management module being located within said exterior sloped shell and wherein said railcar is a passenger railcar.

31. The railcar of claim 20, wherein said pair of corner posts extend substantially vertically and continuously from said chassis up to an upper portion of said railcar.

32. The railcar of claim 26, wherein said crash shield is plate-shaped and wherein said crash shield vertically and laterally links the plurality of energy absorbers together.

* * * * *